US005788349A

United States Patent [19]

DeMaine et al.

[11] Patent Number: 5,788,349

[45] Date of Patent: Aug. 4, 1998

[54] OVERHEAD STORAGE SYSTEM WITH ILLUMINATED SIGNAGE

[75] Inventors: Joseph DeMaine, Walnut; Michael deVorede, Whittier; Phillip Gornall; Mark Gornall, both of Torrence, all of Calif.

[73] Assignee: Trenmark, LaMirada, Calif.

[21] Appl. No.: 555,769

[22] Filed: Nov. 9, 1995

[51] Int. Cl.[6] ..... A47B 80/06

[52] U.S. Cl. ..... 312/223.6; 40/564; 312/245

[58] Field of Search ..... 40/564, 568; 312/223.6, 312/234, 245, 265.3, 265.4, 265.2

[56] References Cited

U.S. PATENT DOCUMENTS

| | | | |
|---|---|---|---|
| 2,448,945 | 9/1948 | Zacharias | 312/234 |
| 3,075,818 | 1/1963 | Fay | 312/265.4 |
| 4,364,616 | 12/1982 | Harkins et al. | 40/568 |
| 4,733,841 | 3/1988 | Wilson | 248/222.1 |
| 4,749,241 | 6/1988 | Thoresen et al. | 312/114 |
| 4,826,115 | 5/1989 | Novitski | 248/225.2 |
| 4,876,835 | 10/1989 | Kelley et al. | 52/239 |
| 4,944,122 | 7/1990 | Wendt | 52/36 |
| 5,038,506 | 8/1991 | Liljeqvist et al. | 40/618 |
| 5,215,366 | 6/1993 | Givens | 312/245 |
| 5,309,686 | 5/1994 | Underwood et al. | 52/29 |
| 5,444,930 | 8/1995 | Loew | 40/544 |

*Primary Examiner*—Peter M. Cuomo
*Assistant Examiner*—Gerald A. Anderson
*Attorney, Agent, or Firm*—Maguire, Voorhis & Wells, P.A.

[57] ABSTRACT

An overhead storage system with an illuminated sign includes a plurality of storage modules aligned end-to-end and, suspended from a ceiling. A sign panel is mounted to the storage modules in fixed space relation to the module, and a fluorescent light fixture is mounted intermediate the sign and storage module. Each module has a pair of rectangular end frame members. A shelf extends horizontally intermediate the frame members and a front panel, substantially perpendicular the shelf, forming a front section of each module and defining a storage capacity of the module. A door is pivotally mounted to the frame members parallel the front panel. Brackets mounted to each frame member adjacent the front panel have a bottom and top extrusion for receiving the sign. A fluorescent light fixture is mounted to the bracket between the sign and front panel. Additionally, a second light fixture is mounted to the bottom of the frame members to provide downlighting.

6 Claims, 3 Drawing Sheets

OVERHEAD STORAGE SYSTEM WITH ILLUMINATED SIGNAGE

FIELD OF THE INVENTION

This invention relates generally to storage or space management systems. More specifically, this invention relates to those storage systems having modules or compartments mountable for overhead storage.

BACKGROUND OF THE INVENTION

In certain business environments, working areas may be quite compact and cramped. For example, the order counter areas of fast food restaurants and convenience stores have a limited area within which to walk or move about. Storage of items is critical, because these areas are in full view of the consuming public. Restaurant and store owners desire to maintain these areas orderly and neat.

In recent years, fast-food restaurants have been placing small restaurant locations within convenience stores. In these arrangements, the restaurants are provided a very limited area in which to operate their business. The problem of storage becomes more important. In addition, there is limited space available to provide signage for advertising. In these convenience stores, the restaurants need sufficiently large signage so customers immediately identify the restaurant areas.

SUMMARY OF THE INVENTION

In view of the foregoing, it is an object of the present invention to provide an overhead storage system having an illuminated signage. Still another objective is to provide the storage system so it is adaptable to varying lengths. Yet another objective is to provide the storage system so the signage is interchangeable. Another objective is to equip the storage system with downlighting for a counter. Still another object of the invention is to provide this storage system with means for attaching the system or modules to existing ceilings.

These and other objectives are achieved in the present invention which includes at least one storage module having an interior storage capacity, an illuminated signage means and means for attaching the storage module to a ceiling. The storage module has two opposing end frames. A bottom shelf extends intermediate the two end frames forming a bottom to the storage module. A front panel, substantially perpendicular the shelf, also extends intermediate the two end frames, and forms the front of the storage module. A bracket mounted to each end frame, adjacent the front panel, holds a translucent sign panel in fixed space relation to the front panel and parallel the front panel. Lighting fixtures are mounted to the brackets between the front panel and sign panel to illuminate the sign panel. Light fixtures are also mounted to the bottom of the end frames to provide downlighting. A door is pivotally mounted to the end frames parallel the front panel. The door pivots upward to provide access to the interior of the storage module. A means for mounting the storage module to a ceiling is secured to the top of each end frame to hold the storage above a desired working area as a counter.

The foregoing and other objects, features and advantages of the invention will be apparent from the following more particular description of a preferred embodiment of the invention as illustrated in the accompanying drawings.

DETAILED DESCRIPTION OF THE DRAWINGS

Figure 1:
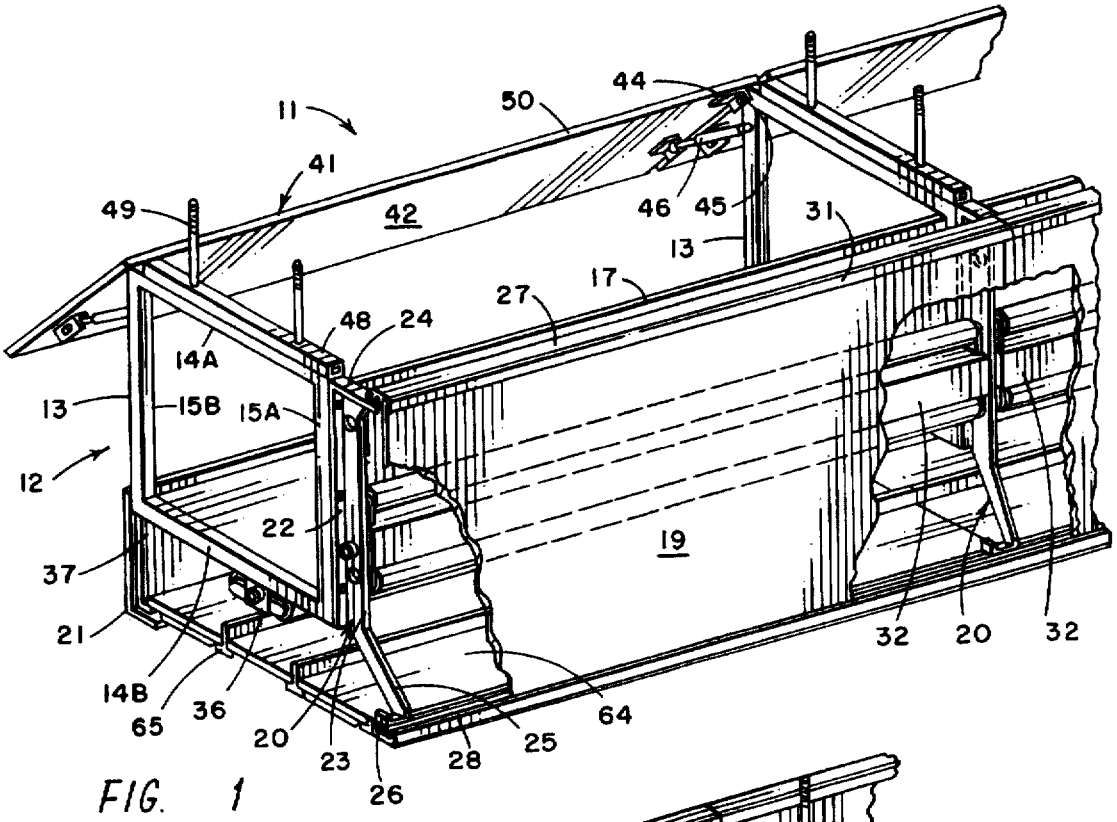
FIG. 1 is a front perspective view of the invention.
Figure 5:
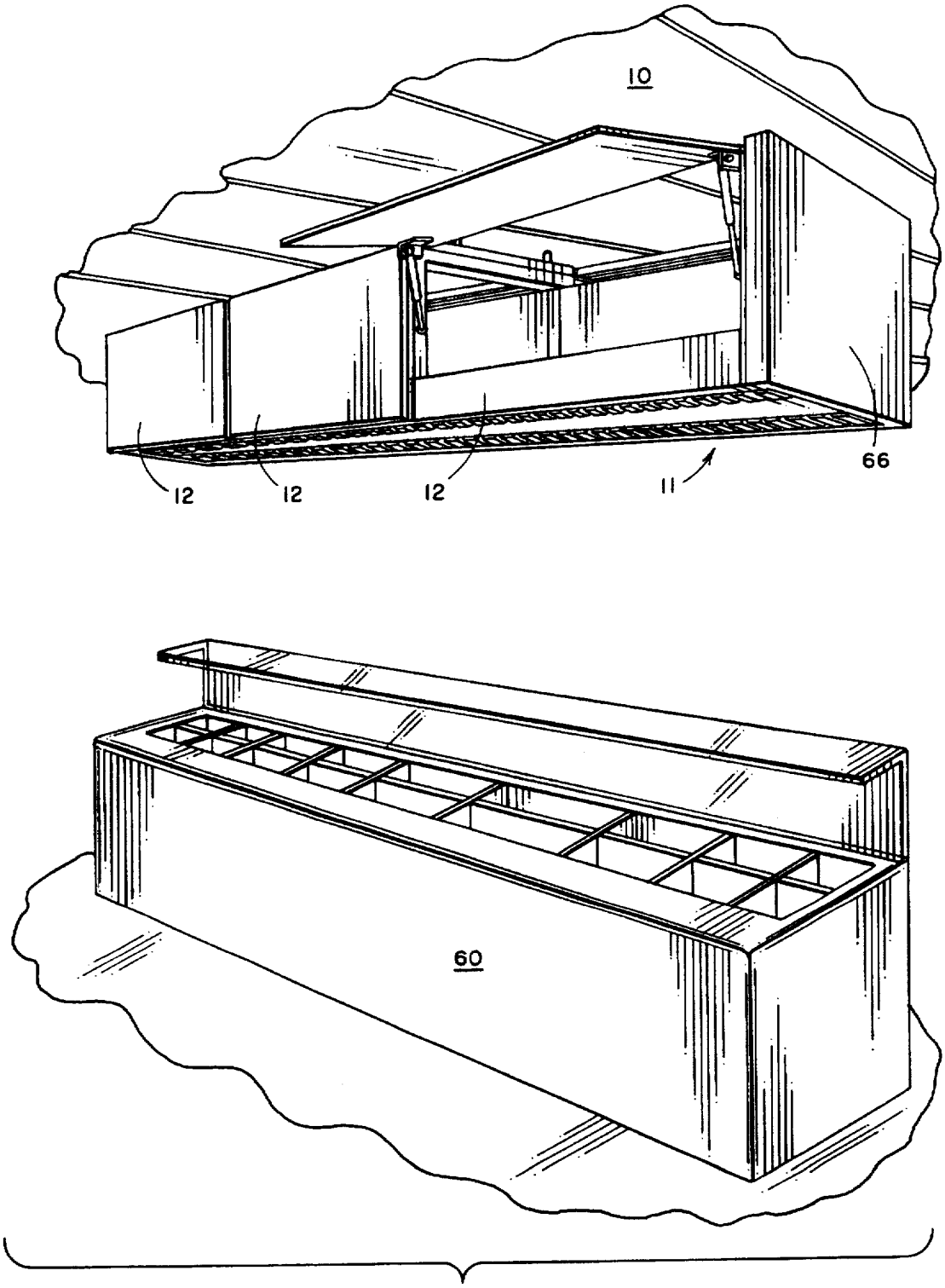
FIG. 5 is a rear perspective view of the invention mounted to a ceiling above a counter.

The storage and illuminated sign system is shown in FIG. 1 and FIG. 5 and designated as 11. In FIG. 5, the storage system is there suspended from a ceiling 10 with a ceiling frame 61 (see FIG. 3) and shown here positioned over a working area as a counter 60. The storage system 11 in FIG. 1 and FIG. 5 shows a plurality of storage modules 12 aligned end-to-end.

The storage module 12 has two end frames 13. Each end frame 13 has a top 14A and bottom 14B horizontal member, and a front 15A and rear 15B vertical member to form a rectangular end frame. As may be appreciated in FIG. 1, when two storage modules are secured together, there is a single end frame 13 intermediate the two storage modules 12. The end frames are preferably constructed of rectangular aluminum tubing to provide a lightweight frame for the storage modules 12. These end frames 13 may vary in size according to the desired size of the storage capacity of the storage module.

Figure 2:
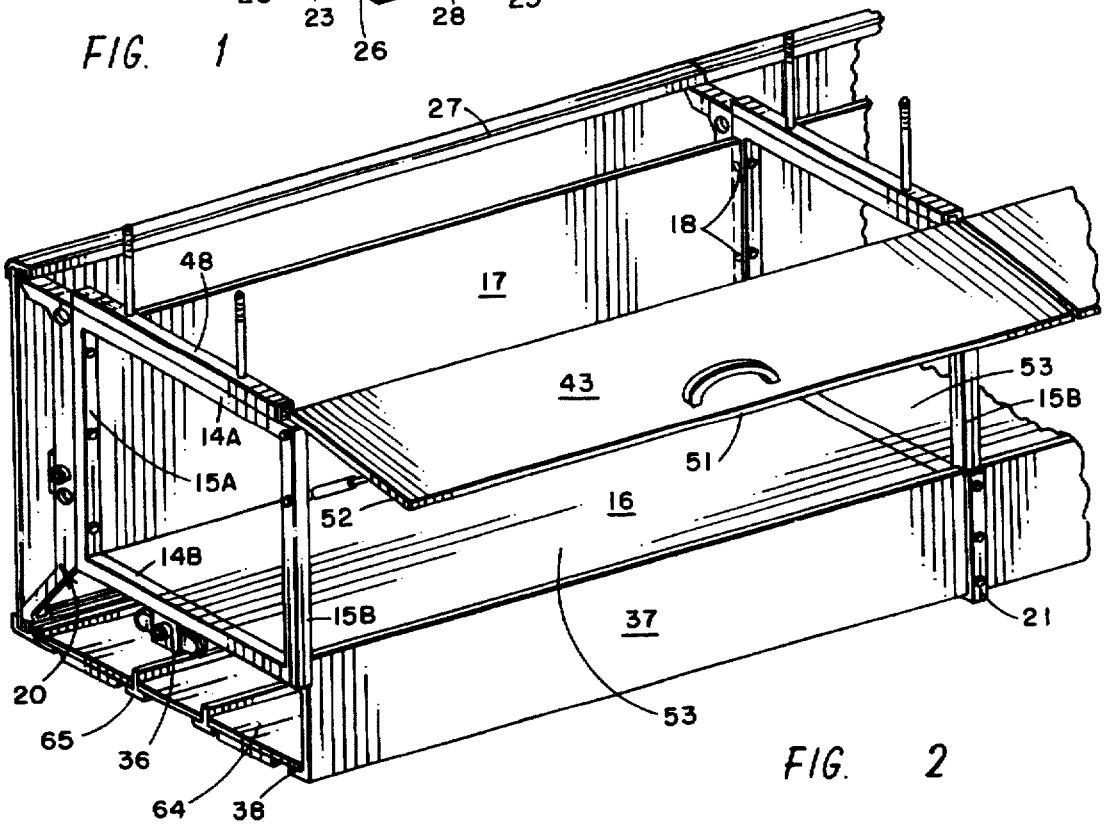
FIG. 2 is a rear perspective view of the invention.

The end frames 13 are held in fixed space relation by rigid panels members 16 and 17. These panels are preferably constructed of a sheet metal such as 18 gauge steel sheet metal. Panel 16 extends intermediate end frames 13 forming a bottom shelf for the storage module 12. The panel has a top surface 53 with two ends 54 depending therefrom abutting the horizontal member 14B. The panel 16 is preferably secured in the storage module so each end 54 of the panel 16 abuts a bottom horizontal 14B. As illustrated in FIG. 2, when storage modules 12 are placed side by side, the two panels 16 abut the end frame 13 so the top surface 53 of each panel 16 is coplanar with an adjacent panel and the top of the bottom horizontal 14B.

Panel 17 is a front panel that also extends intermediate the end frames 13 and is secured thereon to hold the end frames in fixed space relationship. The front panels 17 are mounted to the front vertical members 15A by tap screws 18 similar to the bottom panels 16 so front panels 17 may be secured in the storage modules end-to-end. Each front panel has a side edge 56 that abuts a surface of the front vertical member 15A and is secured against the vertical member 15A with screws 18.

Figure 4:
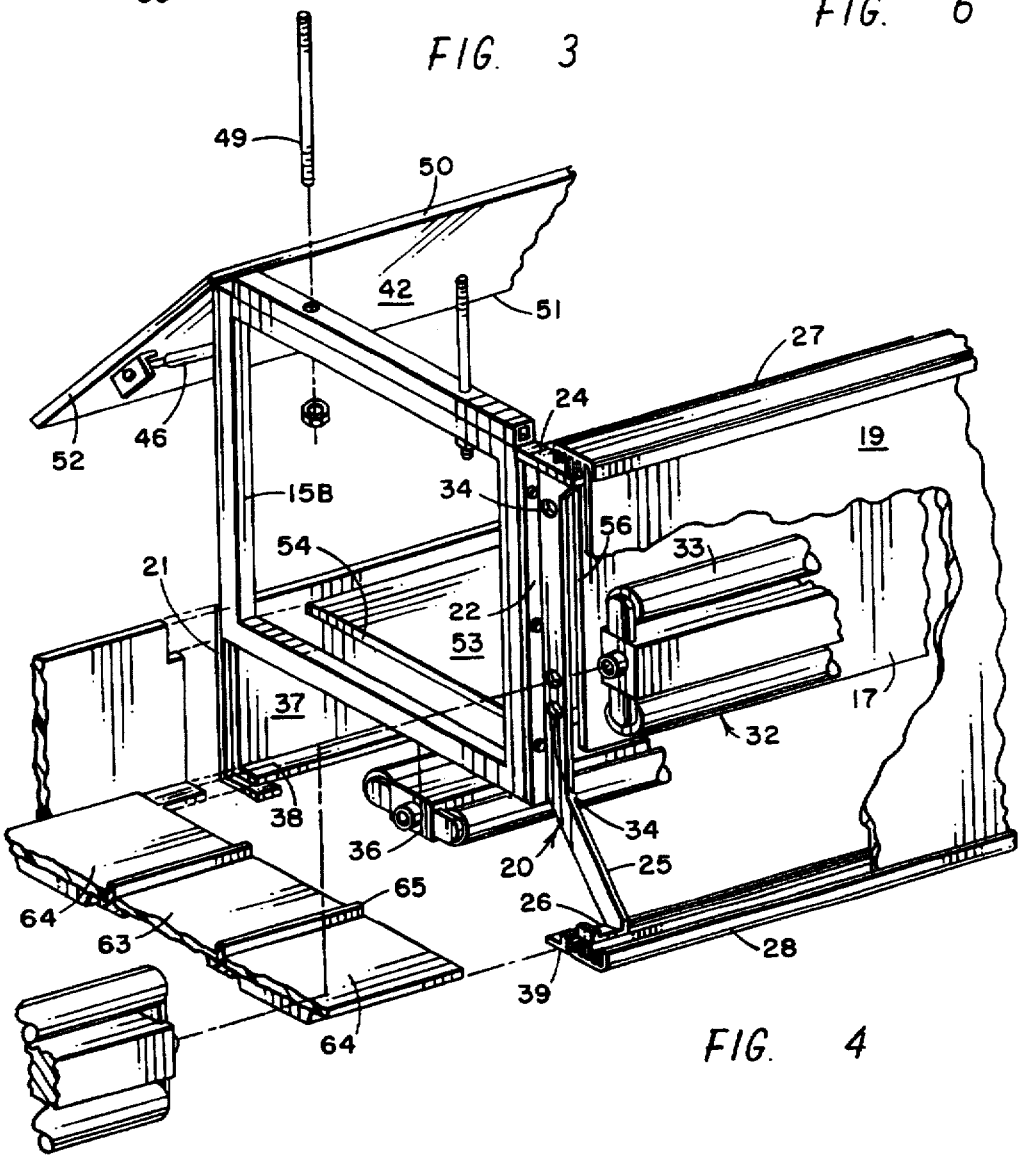
FIG. 4 is an expanded view of the invention.

A translucent sign panel 19 is mounted to the storage module 12 by brackets 20 and extrusion members 21 securing the sign panel 19 parallel, and in fixed space relation to, the front panel 17. As shown in FIG. 1, a bracket 20 is mounted to the front vertical member 15A of each end frame 13. The bracket 20 has a flange 22 that abuts the front vertical member 15A and is bolted thereon securing the bracket 20 to the end frame 13. Bracket 20 also has a vertical plate 23 perpendicular the flange 22 with a first horizontal flange 24 perpendicular the vertical plate 23 extending toward the sign panel 19. An inclined plate 25, integral the bottom of the vertical plate 23, extends at an angle downward toward the bottom of the sign panel 19. A second horizontal flange 26 is integral the bottom of inclined plate 25 as shown in FIG. 4.

With respect to FIGS. 1 and 2, a top aluminum extrusion 27 extends from one bracket 20 to the next. Each end of the top extrusion 27 is mounted to the first horizontal flange 24 of the bracket 20. Similarly, a bottom extrusion 28 extends from one bracket 20 to the next parallel the top extrusion 27. The bottom extrusion 28 is mounted to the second horizontal flange 25 of each bracket 20.

Figure 3:
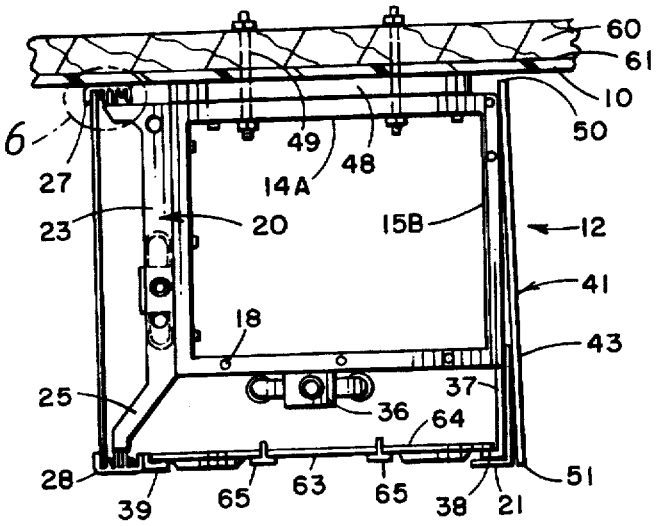
FIG. 3 is a side view of the invention.
Figure 6:
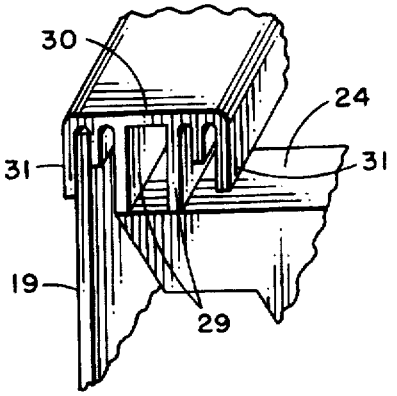
FIG. 6 is an exploded view of the inset of FIG. 3.

As may be better appreciated from FIG. 3, extrusion 27 & 28 provide opposing channels for receiving the edge of the sign panel. The bottom extrusion 28 is similar in structure to the top extrusion and is mounted to the bracket in an upside down position to form a means for securing the sign 19 and a light panel as will be explained below in more detail. The structure of the extrusions 27 and 28 is generally illustrated in FIG. 6. One skilled in the art shall realize that the structure of the extrusion may vary, and the purpose of the structure is to provide the channels for receiving and holding the sign panel in spaced relation to the front panel 17. The extrusion includes two parallel vertical plates 29. A horizontal plate 30 is integral the top of each vertical plate 29. A channel member 31 is integral each end of the horizontal plate 30 and extends parallel each vertical plate 29.

As shown in FIG. 3, each extrusion 27 and 28 is mounted to the end of each bracket 20 distal the storage module 12 so the channel members 31 are positioned apart from bracket. The spaced channel members 31 on the top and bottom extrusions are aligned so the sign panel may be inserted therein in a substantially vertical position securing the sign 19 in spaced relation to the storage module 12 as shown in FIGS. 2 and 3.

With respect to FIGS. 1 and 4, there is shown a fluorescent light fixture 32, with fluorescent bulbs 33, mounted to the brackets 20 intermediate the translucent sign panel 19 and the front panel 17. The fixture 32 is a conventional fluorescent fixture. The bracket 20 preferably has apertures 34 so when storage modules are placed side by side the light fixtures 32 for each storage module are longitudinally aligned and interconnected by a chase nipple 35.

A second fluorescent light fixture 36 is mounted to the underside of each bottom horizontal member 14B of the end frames 13. The light fixture is preferably centrally aligned on each end frame 13 and also is equipped with a chase nipple 35 to interconnect fixtures mounted to adjacent storage modules 12. This second fixture provides downlighting for a counter below the storage system 11.

A base panel 37 extends intermediate the end frames 13 and depends vertically below the bottom shelf of panel 16. The base panel may be constructed of light weight sheet metal. The base panel defines an enclosed area under the storage module 12 for providing downlighting. The base panel 37 has a horizontal extension 38 that extends toward the sign panel 19. The extension 38 may be in the form of an section integral the panel 37 or an L-bracket. An extension 21 attached to the vertical member 15B extends downward abutting the base panel 37 and bolted thereto securing the base panel 37 to the storage module 12.

As shown in FIGS. 2, 3 and 4, a L-bracket 39 is mounted to the bottom of each bracket 20 opposing the horizontal extension 38. As illustrated in FIG. 3, the channel member 31 on the bottom extrusion 28 provides support for the L-bracket 39.

A lighting panel 40 is then placed in the lighting area below the light fixture 36 resting on the horizontal extension 38 and L-bracket 39 as illustrated in FIG. 3. The downlighting fixture panel may vary in structure depending on the type of lighting required. When the storage system is suspended over food counters, it is preferable to enclose the downlighting with a light diffusing panel 63 between two vacuum form panels 64. These panels, 63 and 64, are held together by T-Connectors 65.

A door 41 is pivotally mounted to the rear vertical members 15B of each end frame 13. The door 41 has an interior face 42 toward the storage area of the storage module 12 and an opposing exterior face 43. The door 41 also has a top 50 and bottom 51 edge and two side edges 52. A door bracket 44 is fixed to the interior face 42 of the door toward the top edge 50 of the door 41. The door bracket 44 is also attached to the top of the rear vertical member 15B to pivot about a pin 45. An air piston 46 is also mounted to the door 41 and vertical rear members to facilitate an upward automated opening of the door when the door is lifted by a user. The door 41 has a length equal to the distance from one rear vertical member to the next so the side edges 52 of the door are flush with the outer edge of the rear vertical member 15B. The door 41 also extends downward to the bottom of the base panel 37 so the bottom edge 51 of the door and the base panel 37 are flush as illustrated in FIG. 3.

The base panel 37 is preferably mounted to the inside of the each vertical member 15B and extends intermediate the end frames, so when the door is in a closed position the door 41 rests against the rear vertical members 15B. This particular structure provides aesthetically uniform appearance while also completely enclosing the storage area of the storage module 12.

The invention also includes a means for securing the storage modules 12 with the illuminated sign to a ceiling. A spacer bar 48 is mounted to each top horizontal member of the end frame 13. Two vertical rods 49 are then mounted to the spacer bar 48 and extend upward to engage a ceiling frame. The vertical rods 49 have top and bottom threaded sections to bolt the rod to the spacer bar and a frame member in the ceiling. The storage module 12 is preferably connected to suspended ceilings having a frame work that maintains ceiling tile. The vertical rods are simple bolted to the existing ceiling frame 60 to suspend the storage system above a counter. The light fixtures are then connected to the existing electrical wiring to illuminate the sign and the work area around the counter 60.

Given that the entire storage system 11 is constructed of light weight building materials, the entire structure may be assembled by first securing the spacer bar 48 and end frames 13 to an existing ceiling frame. The remaining parts are lifted and assembled directly with these end frames.

As shown in FIG. 5, the storage system 11 is suspended over a counter 60. While the FIGS. 1–4 have shown the storage modules open at each end frame, the system 11 has each end 67 enclosed. This may be accomplished by simply mounting the brackets 20 and extrusion 27 and 28 on an end frame 13 perpendicular to the sign panel 19 and inserting an additional panel (preferably colored) in the extrusions 27 and 28. This encloses each end 66 of the storage system 11 including the downlighting area.

While the invention has been particularly shown and described with reference to a preferred embodiment thereof, it will be understood by those skilled in the art that the foregoing and other changes in form and details may be made therein without departing from the spirit and scope of the invention.

Having thus described the invention, what we claim as new and desire to secure by Letters Patent is:

1. A storage and illuminated sign system mounted to a ceiling frame, comprising:

(a) at least one storage module suspended from said ceiling frame, and said storage module is a substantially rectangular module having a pair of rectangular end frame members, a bottom shelf extending horizontally intermediate the rectangular end frame members substantially perpendicular the bottom shelf forming a front of the storage module, and a door pivotally attached to said end frame members parallel the front panel;

(b) an interchangeable sign panel secured to each said storage module in fixed space relationship to the storage module;

(c) means, mounted to each said storage module intermediate the sign panel and the storage module, for providing a light source to illuminate the sign panel; and (d) means, mounted to each said storage module, for suspending said modules from the ceiling frame (e) a bracket mounted to each of the rectangular frame members adjacent the front panel and a pair of extrusion members mounted to said brackets with said extrusion member having channel members for receiving the sign panel and securing said sign panel in fixed spaced relationship to the front panel of the storage module.

2. A storage and illuminated sign system as defined in claim 1 further including a second light supply means mounted to the rectangular frame members below the bottom shelf.

3. A storage and illuminated sign system as defined in claim 2 further including a base panel mounted to said rectangular frame members below the door and depending therefrom, and means, mounted to the base panel and the bracket below the bottom shelf, for maintaining a translucent panel for said second light supplying means.

4. A storage and illuminated sign system suspended from a ceiling, comprising:

(a) at least one storage module having with an interior storage capacity defined by a plurality of panels and frame members, whereby said storage module includes a fixed front panel and a rear door panel;

wherein said storage module is a substantially rectangular module having a pair of rectangular end frame members, a bottom shelf extending horizontally intermediate the rectangular end frame members, a front panel extending intermediate said end frame members substantially perpendicular the bottom shelf forming a front of the storage module, and a door pivotally attached to said end frame members parallel the front panel;

(b) a sign panel secured to the storage module in fixed spaced relation to said storage module whereby said sign panel can be interchanged with another sign panel;

(c) means, mounted to said storage module intermediate the storage module and sign panel, for supplying light to illuminate said sign panel; and, (d) means, attached to said storage module, for suspending said module with the sign panel from the ceiling; whereby said system further includes a bracket mounted to each of the rectangular frame members adjacent the front panel and pair of extrusion members mounted to said brackets with said extrusion member having channel members for receiving the sign panel and securing said sign panel in fixed spaced relationship to the front panel of the storage module.

5. A storage and illuminated sign system as defined in claim 4 further including a second light supply means mounted to the rectangular frame members below the bottom shelf.

6. A storage and illuminated sign system as defined in claim 5 further including a base panel mounted to said rectangular frame members below the door and depending therefrom, and means, mounted to the base panel and the bracket below the bottom shelf, for maintaining a translucent panel for said second light supplying means.

* * * * *